US011499369B2

(12) United States Patent
Rejc

(10) Patent No.: US 11,499,369 B2
(45) Date of Patent: Nov. 15, 2022

(54) GATE WITH A CRASH-DOWN PREVENTION MECHANISM AND METHOD FOR TRIGGERING THE CRASH-DOWN PREVENTION MECHANISM

(71) Applicant: Gabrijel Rejc GmbH & Co. KG, Landshut (DE)

(72) Inventor: Gabrijel Rejc, Landshut (DE)

( * ) Notice: Subject to any disclaimer, the term of this patent is extended or adjusted under 35 U.S.C. 154(b) by 200 days.

(21) Appl. No.: 16/470,141

(22) PCT Filed: Dec. 15, 2017

(86) PCT No.: PCT/EP2017/083109
§ 371 (c)(1),
(2) Date: Jun. 14, 2019

(87) PCT Pub. No.: WO2018/109191
PCT Pub. Date: Jun. 21, 2018

(65) Prior Publication Data

US 2019/0360267 A1 Nov. 28, 2019

(30) Foreign Application Priority Data

Dec. 15, 2016 (DE) ..... 10 2016 225 079.5

(51) Int. Cl.
*E06B 9/84* (2006.01)
*E06B 9/13* (2006.01)
*E06B 9/68* (2006.01)

(52) U.S. Cl.
CPC ..... *E06B 9/84* (2013.01); *E06B 9/13* (2013.01); *E06B 9/68* (2013.01); *E06B 2009/6845* (2013.01)

(58) Field of Classification Search
CPC ..... E06B 9/13; E06B 9/15; E06B 9/68; E06B 9/82; E06B 9/84; E06B 9/807;
(Continued)

(56) References Cited

U.S. PATENT DOCUMENTS 1,416,071 A 5/1922 Smurr
1,942,320 A 1/1934 Young
(Continued)

FOREIGN PATENT DOCUMENTS

CN 2122972 U 11/1992
CN 2157356 Y 2/1994
(Continued)

OTHER PUBLICATIONS

ISR with WO for PCT/EP2017/083109 dated Apr. 9, 2018.
(Continued)

*Primary Examiner* — Daniel P Cahn
*Assistant Examiner* — Abe Massad
(74) *Attorney, Agent, or Firm* — Hahn Loeser & Parks LLP; Bret A. Hrivnak

(57) ABSTRACT

The preset invention relates to a gate with a crash-down prevention mechanism, comprising a gate panel which can be opened and closed by the rotation of a gate panel drive, a motor which is coupled to the gate panel drive, and a braking assembly with which opening and/or closing the gate panel can be decelerated, and a first measuring device for determining at least one movement parameter of the gate panel. In order to improve such a gate to the extent that a crash down of the gate can be reliably detected, and a braking assembly which brakes the gate quickly and avoids damage to the gate is triggered just as reliably, it is proposed to provide a second measuring device for determining at least one movement parameter of the motor, and a comparator which compares the measured movement parameters of the gate panel and the motor and triggers the braking assembly when the measured movement parameters of the gate panel and the motor fall outside of a defined relationship to each other.

15 Claims, 8 Drawing Sheets

(58) Field of Classification Search
CPC ..... E06B 2009/6845; E06B 2009/6809; E06B 2009/6818; E06B 2009/6827; E06B 2009/6854; E06B 2009/6863; E06B 2009/807; E05F 15/70; E05F 15/72
See application file for complete search history.

(56) References Cited

U.S. PATENT DOCUMENTS

| | | | | |
|---|---|---|---|---|
| 2,055,511 | A | 9/1936 | Twiss | |
| 2,844,843 | A | 7/1958 | Logan | |
| 3,007,194 | A | 11/1961 | Griswold | |
| 4,119,133 | A | 10/1978 | Wolf | |
| 4,126,173 | A | 11/1978 | Theuerkauff | |
| 4,811,777 | A | 3/1989 | Chretien | |
| 4,888,531 | A * | 12/1989 | Hormann | E05F 15/668 318/467 |
| 4,986,331 | A | 1/1991 | Henkenjohann | |
| 5,065,806 | A | 11/1991 | Kondoh | |
| 5,188,161 | A | 2/1993 | Erber | |
| 5,372,173 | A | 12/1994 | Horner | |
| 5,377,738 | A | 1/1995 | Cooper | |
| 5,394,924 | A | 3/1995 | Rejc | |
| 5,484,007 | A | 1/1996 | Rejc | |
| 5,488,982 | A | 2/1996 | Rejc | |
| 5,535,805 | A | 7/1996 | Kellogg et al. | |
| 5,551,535 | A | 9/1996 | Krolo et al. | |
| 5,566,737 | A | 10/1996 | Erber | |
| 5,711,113 | A | 1/1998 | Nygaard | |
| 5,829,504 | A | 11/1998 | Ekstrand et al. | |
| 5,831,403 | A | 11/1998 | Kanki et al. | |
| 6,041,844 | A | 3/2000 | Kellogg et al. | |
| 6,042,158 | A | 3/2000 | Horn | |
| 6,092,338 | A | 7/2000 | Crowner et al. | |
| 6,123,139 | A | 9/2000 | Kalempa et al. | |
| 6,137,251 | A | 10/2000 | Huang et al. | |
| 6,172,475 | B1 | 1/2001 | Fitzgibbon et al. | |
| 6,289,966 | B1 | 9/2001 | Hoermann | |
| 6,330,903 | B1 | 12/2001 | Weinreich | |
| 6,427,749 | B1 | 8/2002 | Swink et al. | |
| 6,445,152 | B1 * | 9/2002 | Calamatas | G05B 19/416 318/293 |
| 6,672,362 | B1 | 1/2004 | Mullet et al. | |
| 6,920,718 | B2 | 7/2005 | Hom et al. | |
| 6,928,696 | B2 | 8/2005 | Wartman | |
| 7,064,505 | B2 | 6/2006 | Sato | |
| 7,208,897 | B2 | 4/2007 | Hotto et al. | |
| 7,212,897 | B2 | 5/2007 | Suzuki et al. | |
| 7,294,981 | B2 * | 11/2007 | Marty | E06B 9/68 318/558 |
| 7,723,936 | B2 * | 5/2010 | Schaefer | G05B 19/416 318/362 |
| 7,798,198 | B2 | 9/2010 | Rejc et al. | |
| 7,913,739 | B2 | 3/2011 | Rejc et al. | |
| 7,941,972 | B2 | 5/2011 | Kamiya et al. | |
| 8,011,414 | B2 | 9/2011 | Levy et al. | |
| 8,026,809 | B2 | 9/2011 | Schaefer et al. | |
| 8,080,962 | B2 * | 12/2011 | Cooper | H02P 29/0241 318/472 |
| 8,169,169 | B2 | 5/2012 | Hass et al. | |
| 8,899,297 | B2 | 12/2014 | Mazej et al. | |
| 8,991,275 | B2 | 3/2015 | Ishikawa | |
| 9,162,094 | B2 * | 10/2015 | Hsieh | E06B 9/70 |
| 9,217,284 | B2 * | 12/2015 | Panseri | E05D 13/003 |
| 9,243,685 | B2 | 1/2016 | Hawkins et al. | |
| 9,267,326 | B2 | 2/2016 | Gomaa et al. | |
| 9,376,864 | B2 * | 6/2016 | Hsieh | E06B 9/84 |
| 9,416,579 | B2 * | 8/2016 | Rejc | E06B 9/84 |
| 9,487,986 | B2 | 11/2016 | Okachi et al. | |
| 9,504,188 | B1 | 11/2016 | Campbell et al. | |
| 9,624,708 | B2 | 4/2017 | Balay et al. | |
| 9,677,332 | B2 * | 6/2017 | Waehrisch | F16D 51/10 |
| 9,803,420 | B2 | 10/2017 | Ronchetti | |
| 9,915,094 | B2 | 3/2018 | Frede | |
| 10,012,015 | B2 | 7/2018 | Rejc | |
| 10,053,901 | B2 | 8/2018 | Schweiss | |
| 10,174,553 | B2 * | 1/2019 | Mugnier | E06B 9/15 |
| 10,190,362 | B2 | 1/2019 | Fischer | |
| 10,253,557 | B2 | 4/2019 | Frede | |
| 10,344,527 | B2 | 7/2019 | Balbach et al. | |
| 10,829,989 | B2 * | 11/2020 | Rejc | E06B 9/581 |
| 2003/0047291 | A1 | 3/2003 | Klein | |
| 2004/0173326 | A1 | 9/2004 | Dittmer | |
| 2004/0183677 | A1 | 9/2004 | Fitzgibbon | |
| 2005/0126720 | A1 | 6/2005 | Rekret | |
| 2006/0162876 | A1 | 7/2006 | Kwak | |
| 2007/0062650 | A1 | 3/2007 | Rejc | |
| 2007/0194218 | A1 * | 8/2007 | Mullet | E05F 15/668 250/231.13 |
| 2008/0036409 | A1 | 2/2008 | Schaefer | |
| 2008/0210386 | A1 | 9/2008 | Neuhaus | |
| 2008/0224642 | A1 * | 9/2008 | Rodriguez | E05F 15/70 318/466 |
| 2009/0020237 | A1 | 1/2009 | Lambridis et al. | |
| 2011/0146920 | A1 | 6/2011 | Mazej et al. | |
| 2011/0271595 | A1 | 11/2011 | Eggeling et al. | |
| 2013/0112357 | A1 | 5/2013 | Gontarski et al. | |
| 2014/0117757 | A1 | 5/2014 | Tsui et al. | |
| 2014/0332172 | A1 * | 11/2014 | Hsieh | E06B 9/84 160/133 |
| 2015/0300084 | A1 | 10/2015 | Schonerwald | |
| 2015/0322703 | A1 | 11/2015 | Matsuo | |
| 2015/0368962 | A1 | 12/2015 | Motosko et al. | |
| 2016/0319598 | A1 * | 11/2016 | Waehrisch | F16D 49/16 |
| 2016/0348429 | A1 | 12/2016 | Frede | |
| 2017/0009524 | A1 | 1/2017 | Dwarka | |
| 2018/0073296 | A1 | 3/2018 | Chen | |
| 2018/0258689 | A1 | 9/2018 | Rejc | |
| 2018/0313140 | A1 | 11/2018 | Rejc | |
| 2019/0390511 | A1 | 12/2019 | Lambridis et al. | |
| 2020/0164915 | A1 | 5/2020 | Kim | |

FOREIGN PATENT DOCUMENTS

| | | | | |
|---|---|---|---|---|
| CN | 103775561 | A | 5/2014 | |
| CN | 203959606 | U | 11/2014 | |
| CN | 105275376 | A | 1/2016 | |
| CN | 105952304 | A | 9/2016 | |
| DE | 7426752 | U | 5/1975 | |
| DE | 2542801 | A1 | 4/1976 | |
| DE | 2935490 | A1 | 3/1981 | |
| DE | 3513700 | A1 | 10/1986 | |
| DE | 4015214 | A1 | 11/1991 | |
| DE | 19831806 | A1 | 1/1999 | |
| DE | 19952038 | A1 | 10/2000 | |
| DE | 10011789 | A1 | 9/2001 | |
| DE | 20112771 | U1 | 1/2002 | |
| DE | 10232577 | A1 | 2/2004 | |
| DE | 60309310 | T2 | 5/2007 | |
| DE | 102006033708 | A1 | 8/2007 | |
| DE | 102009044492 | A1 | 5/2011 | |
| DE | 102012101415 | B3 | 3/2013 | |
| DE | 202012012514 | U1 | 6/2013 | |
| EP | 0056650 | A2 | 7/1982 | |
| EP | 0128391 | A2 | 12/1984 | |
| EP | 0808985 | A2 * | 11/1997 | E06B 9/82 |
| EP | 0808985 | A2 | 11/1997 | |
| EP | 0945575 | A2 | 9/1999 | |
| EP | 1816307 | A1 | 8/2007 | |
| EP | 1882802 | A2 | 1/2008 | |
| EP | 2148040 | A1 | 1/2010 | |
| EP | 2887535 | A1 | 6/2015 | |
| GB | 570469 | A | 7/1945 | |
| GB | 746253 | A | 3/1956 | |
| GB | 1013644 | A | 12/1965 | |
| GB | 2141171 | A | 12/1984 | |
| JP | S56167085 | A | 12/1981 | |
| JP | 07006491 | U | 1/1995 | |
| JP | 07023191 | U | 4/1995 | |
| JP | 2003184454 | A | 7/2003 | |
| JP | 2007177430 | A | 7/2007 | |
| JP | 2008261182 | A | 10/2008 | |
| JP | 2008291546 | A | 12/2008 | |
| JP | 2011213557 | A | 10/2011 | |

(56) References Cited

FOREIGN PATENT DOCUMENTS

| | | | |
|---|---|---|---|
| JP | 2012500347 | A | 1/2012 |
| WO | 9839542 | A1 | 9/1998 |
| WO | 2007045423 | A1 | 4/2007 |
| WO | 2009112562 | A1 | 9/2009 |
| WO | 2015144729 | A1 | 10/2015 |

OTHER PUBLICATIONS

EP161765490.0 European Search Report dated Nov. 9, 2016, 9 pages.
EP16176550.8—European Search Report dated Oct. 18, 2016, 4 pages.
PCT/EP2017/065622 International Search Report dated Sep. 26, 2017, 6 pages.
PCT/EP2017/065623 International Search Report dated Sep. 28, 2017, 6 pages.
PCT/EP2017/079330 International Search Report and Written Opinion dated Mar. 1, 2018, 11 pages.

* cited by examiner

GATE WITH A CRASH-DOWN PREVENTION MECHANISM AND METHOD FOR TRIGGERING THE CRASH-DOWN PREVENTION MECHANISM

The present invention relates to a gate with a crash-down prevention mechanism according to the preamble of claim 1.

Such gates are suitable, inter alia, for industrial applications, for locking production facilities, workshops and warehouses. For example, they are designed to reduce air movement and help maintain temperatures in cooled or heated areas. Typical embodiments for gates with vertically movable gate leaves are sectional gates, rolling gates and spiral gates. Such gates can have gate leaves separated into sections that are movable relative to each other and which are guided laterally in the gate frames and opened or closed with a vertical movement.

Gates with vertically movable gate leaves can be embodied with or without a weight counterbalancing mechanism. Known weight counterbalancing mechanisms include springs that are tensioned when the gate is closed and relax when the gate is opened, where the energy stored in the spring assists in opening the gate, thus allowing the gate to be moved with less effort. Gates with no weight counterbalancing mechanism reduce the production effort and the susceptibility to wear.

Gates in industrial applications are often powered by electric motors; the motor is typically connected to the gate panel by way of a gearing, where mainly worm gearings but also spur gearings, chain or belt drives are employed.

One direction of development of generic gates is geared toward their speed of movement. Gate leaves of modern high-speed gates typically achieve travel speeds of up to 4 m/s.

A parallel direction of development is geared toward increasing service life, where modern gates can complete up to 50,000 or more opening and closing cycles without failure.

This combination of high movement speeds/accelerations and very many movement cycles leads to high material stress and consequently to increased risk of material failure due to wear. Susceptible to wear are predominantly parts subject to friction such as the motor, the gate panel drive, the gearing as well as the connections between the gearing and the motor or gate panel drive, respectively. Failure, such as material failure, in one of these gate components can result in the gate panel crashing down. This leads to great danger for objects and especially for people who are located in the gate opening when it crashes down.

To minimize such dangers, gates can have an effective crash-down prevention mechanism. Known crash-down prevention mechanisms comprise mechanisms for detecting a gate panel crash down and then triggering a crash-down prevention block.

The German utility model (GM) 74 26 752 discloses a crash-down prevention mechanism for a generic rolling gate. Said rolling gate consists substantially of movably interconnected slats which are wound up on a winding shaft mounted in the region of the gate frame when the gate is opened. The rotating winding shaft is connected to an electric motor by way of a worm gearing. In the event that the gear breaks, a crash-down prevention mechanism is triggered and comprises two locking pins attached to the lowermost gate slat. These locking pins that are pretensioned during operation are driven outwardly into correspondingly shaped openings in the gate frame when the crash-down prevention mechanism is triggered and thus brake the gate in an abrupt manner. The crash-down prevention mechanism is triggered by way of a rotational speed sensor which determines the rotational speed of the winding shaft. Prior to the gate being operated, a rotational speed limit is defined above which safe operation of the gate cannot be guaranteed, but where a crash down must be assumed. When said rotational speed limit is exceeded, the crash-down prevention mechanism is triggered. The rotational speed of the winding shaft in terms of the rotational speed limit is the monitoring variable, on the basis of which a malfunction can be detected. Faults in the gate which do not lead to an increase in the rotational speed or, for example, to uncontrolled lowering of the gate at a low rotational speed, do not lead to the crash-down prevention mechanism being triggered.

The invention is based on the object of providing a generic gate with a crash-down prevention mechanism and a method for triggering a crash-down prevention mechanism which reliably detects a crash down of the gate panel, and just as reliably triggers a braking assembly which brakes the gate quickly while avoiding damage to the gate.

In terms of the device, said object is satisfied by a gate with a crash-down prevention mechanism having the features of claim 1.

Coupling the gate panel drive to the motor leads to a defined relationship of the positions and movements of the gate panel, the gate panel drive, and the motor that are defined by the design. Depending on the embodiment, this relationship can be given, for example, by the gear ratio of a gearing between the motor and gate panel drive, or generally the type of coupling of the motor to the gate panel drive, respectively. During normal operation of the gate, the movement parameters of the gate panel can be determined from the movement parameter of the motor on the basis of this defined relationship, and vice versa. If said movement parameters of the motor and the gate panel fall outside this fixed relationship, a malfunction of the gate, such as a crash down, is to be assumed.

According to the invention, the movement parameters of the gate panel and of the motor are determined by the first and the second measuring devices and the values measured are evaluated in a comparator in which the normal relationship of the movement parameters based on the design is stored. The braking assembly is triggered if the relationship of the movement parameters measured fall outside the defined relationship.

The second measuring device measures at least one component of movement of the motor at the motor. The current operating state of the motor can thus be determined and a reasonable assessment of the operating state of the entire gate can be made.

The data measured can be evaluated quickly by using a comparator to automatically initiate a braking action of the gate in the event of a malfunction.

A high level of safety is achieved when the braking assembly is reliably triggered in the event of malfunctions. The crash-down prevention mechanism is also triggered if the gate panel crashes down at a movement speed which is equal to or less than the closing speed of the gate during normal operation, i.e. comes down slowly but in an uncontrolled manner. Furthermore, it is possible to stop the crashing gate panel very soon after the beginning of the uncontrolled downward motion, advantageously even before it reaches a high falling speed and accordingly requires large braking forces.

According to one embodiment, a movement parameter of the gate panel determined by the first measuring device can be a translation speed of the gate panel. A crash-down of the gate is expressed primarily by dropping down, i.e. a very rapid downward motion of the gate panel. By measuring the speed of the gate panel, a crash-down is accordingly detectable very reliably.

In one further development, a movement parameter of the gate panel determined by the first measuring device can be an angular position of the rotating gate panel drive. The angular position can be determined advantageously and in a space-saving manner close to the gate panel drive and independently of the current rotational speed of the gate panel drive, which is dependent on the operating state.

A movement parameter of the motor determined by the second measuring device can advantageously be a rotational speed of a rotating motor shaft. The rotational speed of the motor shaft can be conveniently determined directly in the vicinity of the motor.

A movement parameter of the motor determined by the second measuring device can conceivably also be an angular position of a rotating motor shaft. As an alternative or in addition to determining the motor shaft rotational speed, the angular position of the motor shaft can also be measured in a space-saving manner in the vicinity of the motor.

In an advantageous variant, the braking assembly can comprise a friction brake. A friction brake allows for actively controlling the braking force to obtain a controlled deceleration of the gate panel. This enables influencing the stopping distance and the forces arising from the negative acceleration on the gate panel and the other components of the gate.

According to one embodiment of the invention, a braking element of the friction brake can be in frictional engagement with a braking surface rotating along with the gate panel shaft when the braking assembly is triggered. With the frictional engagement, the gate panel is decelerated in dependence of the surfaces rubbing against each other and the force acting between the braking element and the braking surface. The brake acting on the gate panel shaft can be placed in a space-saving manner in the region of the gate panel shaft and independently of the extension of the gate panel in the closed state.

In one possible implementation of the invention, the motor can be adapted to be controlled to a standstill of the motor, where the gate panel can be held in a position and where the motor can be embodied, in particular, as a synchronous motor. As a result, reliably braking and holding the gate is possible during normal operation of the gate. At the same time the wear in the system arising during the braking action can be reduced. In particular, synchronous motors are suitable to provide a high torque even at low rotational speeds, or when the motor shaft is not moving, to decelerate the gate panel or hold it motionless.

The braking assembly can possibly stop a closing motion of the gate panel within a defined stopping distance. As a result, the forces arising in the entire gate during the deceleration can be limited to avoid damage to the gate, while the gate panel is braked fast enough to prevent damage and injury to objects and people in the gate area.

In one embodiment of the invention, at least one drive wheel formed on the gate panel drive can engage at least one drive device extending in a height direction of the gate, where the drive device may be a drive chain in one embodiment. This achieves a good coupling between the gate panel drive and the gate panel and ensures reliable movement of the gate panel, in particular at high speeds of movement.

According to one embodiment, the gate panel can be stored in an open position in a kind of spiral guide. This allows the gate panel to be stored in a particularly space-saving manner while the gate is open.

The object of the invention is also satisfied with a method having the features of claim 12.

The movement parameters of the motor and the gate panel measured are compared in the comparator. Based on the configuration of the gate, these movement parameters are in a defined relationship to one another in all normal operating states of the gate, so that any deviation from this relationship indicates damage to the gate and the risk of the gate panel crashing down. If, in the comparison to the previously measured motion parameters, such a deviation is determined in the comparator outside of specified tolerances, a braking assembly is triggered in order to prevent the gate panel from crashing down and to decelerate the gate.

This fault identification can be performed reliably in all operating states. The gate can be braked, in particular, already at speeds below the normal speed of the gate panel, for example, at the beginning of the crashing motion or when the gate lowers in a slow but uncontrolled manner.

Conveniently, a translation speed of the gate panel can be determined by way of the first measuring device. As a result, the gate crashing down, which is accompanied by a downward motion of the gate panel at an uncontrolled speed of the gate panel, can be determined directly at the gate panel and therefore very reliably.

In one variant, an angular position of the gate panel drive can be determined by way of the first measuring device. The angular position of the gate panel drive can be determined directly at the gate panel drive and be done by way of a space-saving arrangement of the second measuring device.

According to one embodiment, a rotational speed of a rotating motor shaft of the motor can be determined by way of the second measuring device. The rotational speed is well suited to characterize the motion of the motor and can be relatively easily measured directly at the motor.

In one further development of the invention, the angular position of a rotating motor shaft of the motor can be determined by way of the second measuring device. Irrespective of the rotational speed, the instantaneous orientation of the rotating motor shaft can be conveniently determined directly in the vicinity of the motor.

Opening and/or closing of the gate can advantageously be decelerated by way of a friction brake. As a result, controlling the braking force with which the gate panel can be decelerated is thus made possible so that risks to people and objects are kept low in the region of the gate and damage to the gate due to high braking forces and abrupt deceleration are avoided at the same time.

By triggering the braking assembly, a braking element can be made to frictionally engage one embodiment with a braking surface rotating along with the gate panel drive. The braking element can be configured in a space-saving manner in the region of the gate panel drive and achieve a controlled braking effect by way of the frictional engagement.

The braking assembly can possibly stop the closing motion of the gate within a defined stopping distance. By defining the stopping distance, it is possible to ensure, firstly, that the gate is stopped fast enough to ensure safety of people and objects in the region of the gate in the event of a crash down, and at the same time the deceleration can be limited to prevent damage to the gate due to an abrupt braking action.

Several exemplary embodiments of the invention shall be explained hereafter with reference to the drawings, where:

Same reference numerals are used for same or corresponding features in the different figures and with reference to different embodiments. An explanation of corresponding or same features is dispensed with regarding the subsequent figures if they have already been explained.

The following embodiments relate mainly to high-speed gates, i.e. gates whose gate leaves reach vertical velocities of more than 1.5 m/s, 2 m/s and are in particular in the range of 2 to 4 m/s.

Figure 1:
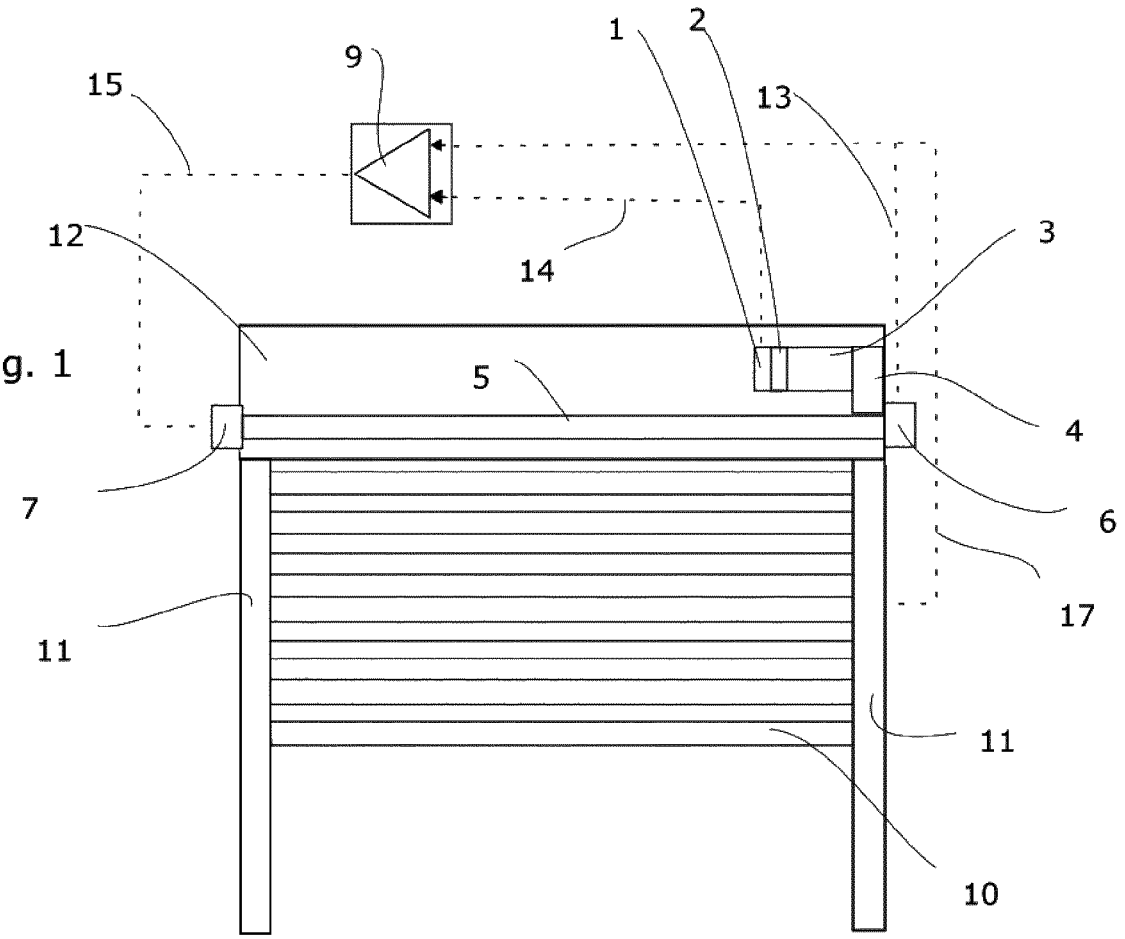
FIG. 1 shows a schematic diagram of a gate with a crash-down prevention mechanism according to the invention.

FIG. 1 schematically shows a top view of a partially open gate, open to about one third. Gate panel 10 extends between two gate frames 11 in which it is guided laterally. Formed above the gate opening in the region of the gate lintel 12 is a gate panel shaft 5 which belongs to a gate panel drive and extends approximately over the entire width of the gate.

The gate panel is embodied as sections that are aligned in parallel and movable relative to each other. At its oppositely disposed horizontal ends, the gate panel is respectively connected to a drive chain which extends within one of the gate frames. A respective gear wheel that is rigidly connected to gate drive shaft 5 engages each of the drive chains. As a result, a rotation of the gate panel shaft 5 leads to the gate panel lifting and lowering. The gate panel is guided past the gate panel shaft in a spiral-shaped rail in which the gate panel is stored in the open state. In alternative embodiments, the gate is designed as a rolling gate with a flexible gate panel which is wound up onto the gate panel shaft.

The gate panel drive with gate panel shaft 5 is connected via a gearing 4 to an electric motor 3, where the connection between the motor and gate panel shaft 5 is realized by way of a chain drive. Alternative embodiments can also be equipped with belt, spur, bevel or worm gearings or also dispense with a gearing. For example, the motor shaft can be connected directly to the gate panel shaft in a gearless manner. Embodied on the motor is a holding brake 2 which brakes the motor and, due to the coupling of the motor and the gate panel drive, also brakes the gate panel during normal operation and can hold it in one position. The gate comprises no weight counterbalancing mechanism. In alternative embodiments, for example, tension or compression springs can be formed in the frames or in the lintel as weight compensation mechanisms.

One example of the structural design of a gate which can be equipped with a crash-down prevention mechanism according to the invention is disclosed in EP 16 176 550.8. The gate described therein comprises a sectional gate panel which in the open state is stored in a spiral, where gear wheels engage drive chains embodied on both sides of the gate panel. The motor is coupled to a drive shaft of the gate panel by way of a belt.

Also embodied on the motor is a second measuring device 1 which measures a rotational speed of the motor shaft of electric motor 3. Rotational speed measuring methods, for example, by way of induction sensors or light barriers known from prior art are used there.

These rotational speed measuring methods provide digital information on the distance traveled by the motor shaft in the form of square wave signals which are counted in control units. Alternatively, the angular position in the form of phase-shifted sine/cosine functions can be represented by the measuring device.

In the embodiment shown, the measuring device is a rotary feedback system that outputs both the angular position over sine/cosine periods as well as the absolute number of revolutions as digital information. In this embodiment, the measuring device can be used simultaneously for the commutation of the motor. The absolute position is output as digital information having a certain resolution. The resolution should be as high as possible to achieve short response times and stopping distances.

Embodied at the gate panel shaft 5 is a first measuring device 6 which also measures the rotational speed of gate panel shaft 5 by way of a known rotational speed measuring method.

In the embodiment shown, the first measuring device is a sensor system that outputs pulses that are phase-shifted relative to one another on two signal coils.

The measured values of the first and the second measuring device are transmitted via lines 13, 14 to a comparator 9. The transmission of the measurements can take place as analog voltage values or in digital form if the first and the second measuring device can already convert the rotational speed values measured into digital signals. Digital transmission of measurements is generally preferred. The comparator can be configured as an electronic component. Alternatively, the comparator can also be realized as a digital component or by software.

Conclusions about the speed can be drawn from the changes in the position values of the two measuring devices by reference to the elapsed time.

Alternatively or in addition to measuring the rotational speed of gate panel shaft 5, its angular position or, with the aid of light barriers in frames 11, the speed and position of the gate panel can be determined. The measured values are transmitted from frames 11 through a line 17 to comparator 9.

In such embodiments, the first measuring device is, for example, a light grid which is located directly in the plane of motion of the gate panel and, when a specific light beam is interrupted, delivers the position of the interrupted light beam to comparator 9.

The measured values transmitted by the two measuring devices are related in comparator 9 to the rotational speeds of the gate panel shaft and the motor shaft relative to each other. Since gate panel shaft 5 and motor shaft 3 are coupled to each other by way of gearing 4, their rotational speeds must be in a fixed relationship to each other in all opening states. If it is determined in the comparator that the actual relationship between the speeds measured deviates from the relationship based on design-engineering, it is assumed that a decoupling between the gate panel drive and motor 3 has occurred, which can be caused, for example, by a gearing failure and in the worst case results in a crash down of gate panel 10. In this case, catch brake 7 is triggered immediately by the comparator in that a brake signal is passed through line 15 to catch brake 7.

In the embodiment illustrated, the comparator is configured such that it can input the absolute position values of measuring device 6 and can count in parallel the pulses arriving from the second measuring device. The phase shift of the incoming signals makes it possible to distinguish between a subtraction and an addition.

A diverse and reliable redundancy can be ensured when choosing different distance measuring methods. The motion parameters of the motor and of the gate panel are continuously determined and evaluated in the comparator during the operation of the gate.

Figure 2:
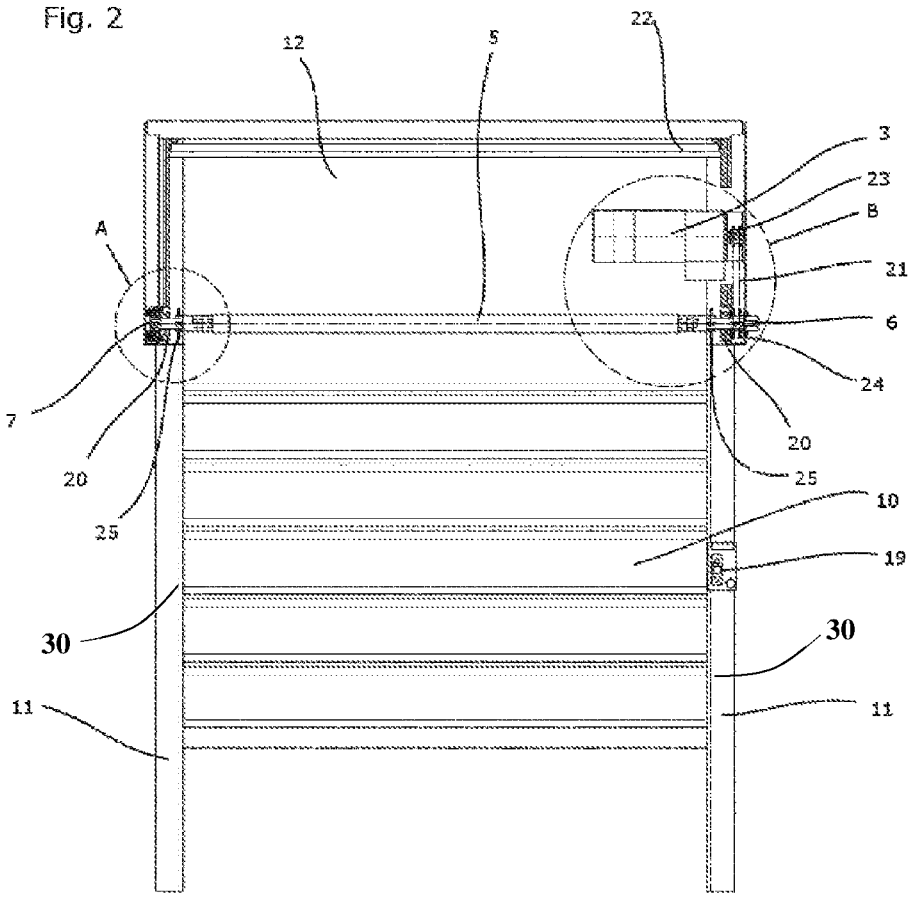
FIG. 2 shows a sectional view of a second embodiment of the invention in the direction of passage.

FIG. 2 shows a second embodiment in a sectional view. Provided to the right-hand side of gate panel 10 in a gate frame 11 is a controller 19 to be operated from the outside in which the motor controller and the comparator 9 are likewise embodied. The lines between comparator 9 and measuring devices 1, 6 are led within gate frames 11 and lintel 12. Gate panel shaft 5, which lies in the sectional plane, is supported at both ends in the region of the gate frames by a respective rolling bearing 20.

The power transmission between motor 3 and gate panel shaft 5 is effected by use of a chain 21 which is respectively run on a chain wheel 23 of the motor shaft and a chain wheel 24 of gate panel shaft 5.

Motor 3 is embodied within spiral 22, in which gate panel 10 is stored in the open state.

Second measuring device 1 is embodied within the housing of motor 3. First measuring device 6 is embodied at the motor-side end of the gate panel shaft. Also embodied within the motor housing is a mechanical service brake which is used to brake the motor and the gate panel coupled thereto during normal operation and to hold it in a position.

Embodied at both ends of gate panel shaft 5 are drive wheels 25 which engage a drive device 30, shown as a drive chain, of the gate panel and thus convert the rotation of drive shaft 5 to a linear motion of the gate panel.

Figure 3:
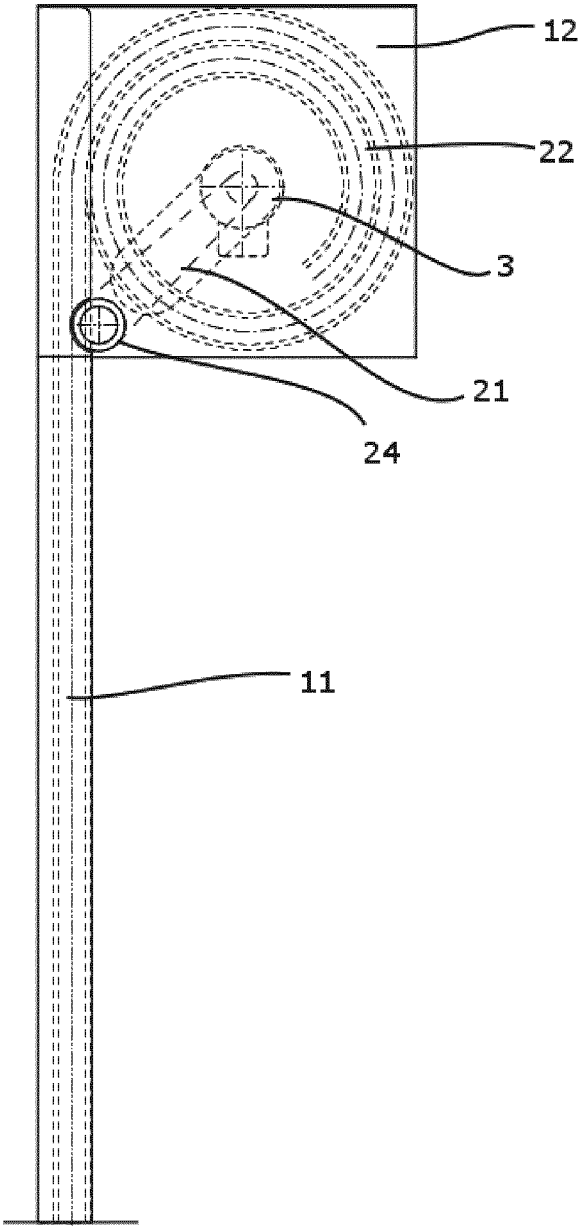
FIG. 3 shows a lateral view of the embodiment of FIG. 2 from the right-hand side.

FIG. 3 shows the gate shown in FIG. 2 from the right-hand side. Well visible is the arrangement of spiral 22 in lintel 12 and the space-saving arrangement of motor 3 within spiral 22. Chain 21 is guided laterally past the spiral to transmit power from motor 3 via chain wheel 24 to gate panel shaft 5.

Figure 4:
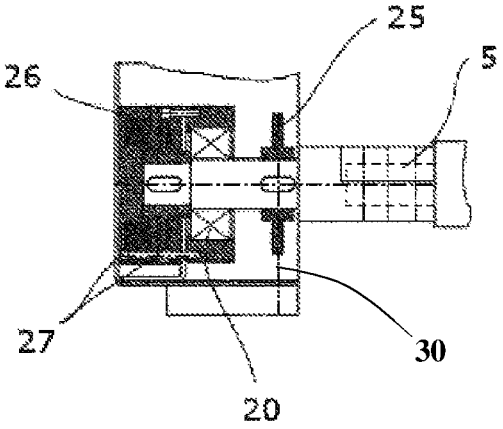
FIG. 4 shows an enlargement of region A in FIG. 2.

FIG. 4 shows enlarged the region marked A in FIG. 2. Catch brake 7 at the left-hand end of gate panel shaft 5 can be seen particularly clearly.

Catch brake 7 is embodied as a spring-applied disk brake. In the embodiment, a brake disk 26 is embodied in a rotationally fixed manner on the gate panel shaft. Two brake shoes 27 with brake pads mounted on both sides of the brake disk are pretensioned by spring force in the direction of brake disk 26 and kept spaced from the brake disk against the spring force by way of an electromagnet. To trigger catch brake 7, the electromagnets are deactivated so that brake shoes 27 are pressed by the spring force against the brake disk and brake gate panel shaft 5. This arrangement has the further advantage that it is automatically activated also in the event of a power outage and triggers the brake.

Figure 5:
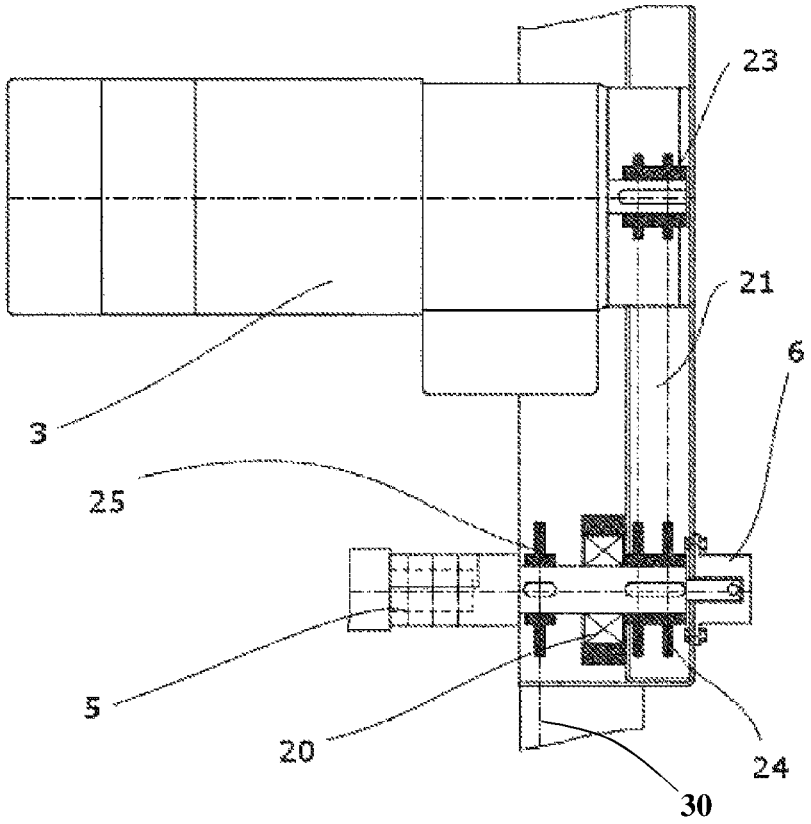
FIG. 5 shows an enlargement of region B in FIG. 2.

FIG. 5 shows enlarged the region marked B in FIG. 2 and shows in particular the connection between motor 3 and gate panel shaft 5 by way chain wheels 23, and chain 21. First measuring device 6 is embodied at the right-hand end of gate panel shaft 5.

Figure 6:
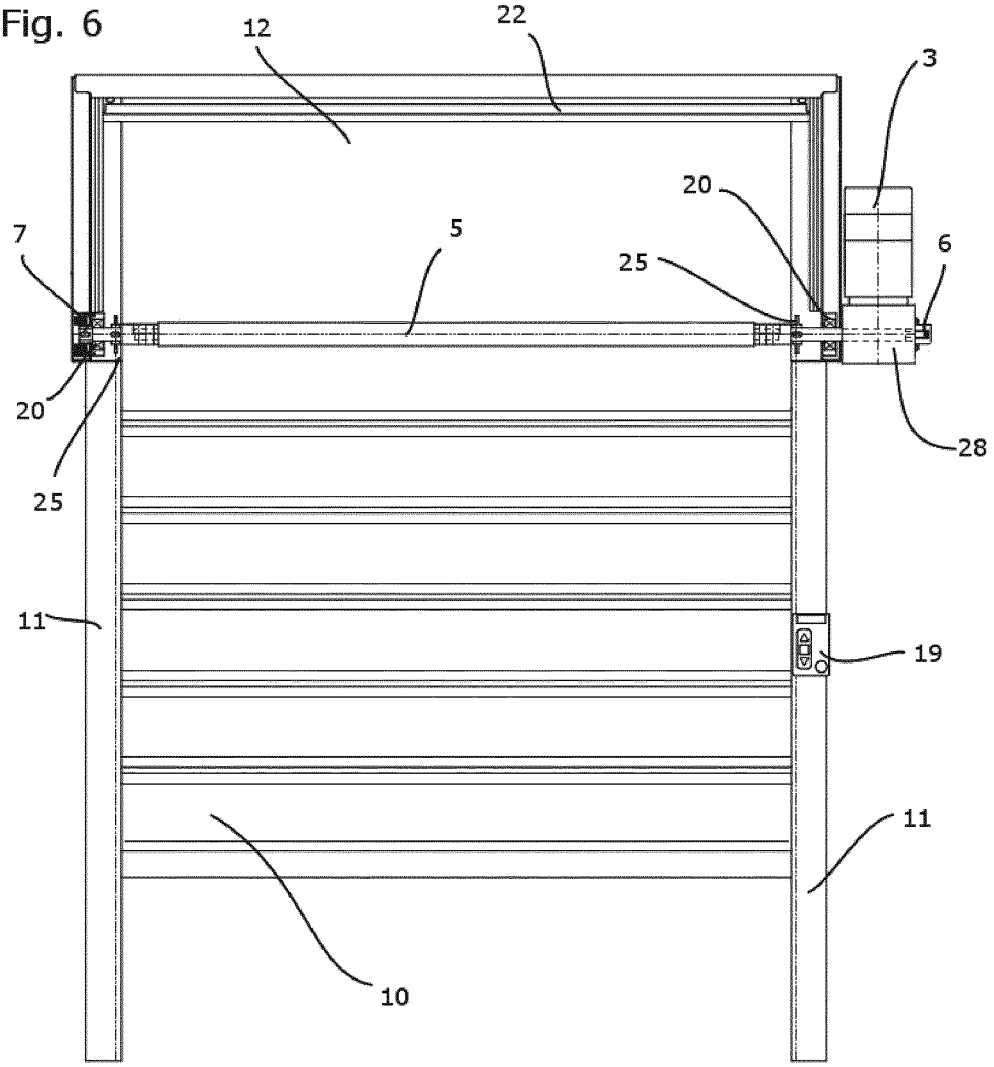
FIG. 6 shows a sectional view of a third embodiment.

The embodiment shown in FIG. 6 is substantially similar to the second embodiment in FIGS. 2 to 5. The main difference is that the motor shaft and gate panel shaft 5 are there at a right angle to each other. Power transmission is effected by way of an angular gearing 28 with a bevel spur gear. Alternatively, the embodiment as a worm gearing or the like is conceivable.

Figure 7:
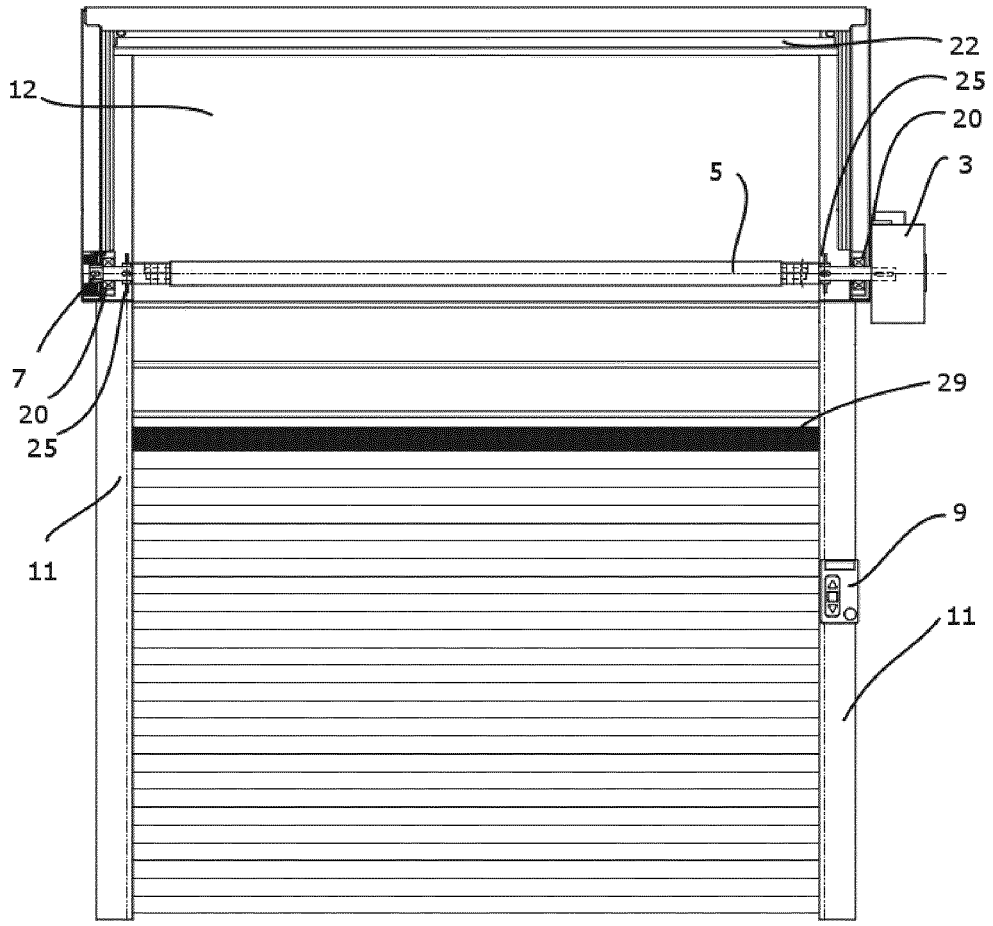
FIG. 7 shows a sectional view of a fourth embodiment.

The embodiment shown in FIG. 7 substantially corresponds to the embodiment in FIGS. 2 to 5. Significant differences are the use of a synchronous motor 3 which can be regulated down to zero rotational speed and can brake and hold the gate panel during operation. The motor therefore requires no additional mechanical service brake in the motor housing and no transmission gearing. The motor shaft is directly coupled to gate panel shaft 5.

A potential crash down of the gate panel is determined by way of a measuring section 29, at which by way of a light barrier arrangement preferably by way of a light grid which forms horizontally mounted light barriers which are arranged vertically one above the other, the positions and/or the movement speed of the gate panel is determined. This measured value is compared in the comparator to the measurement at the motor shaft in order to detect a failure of the gate.

Figure 8:
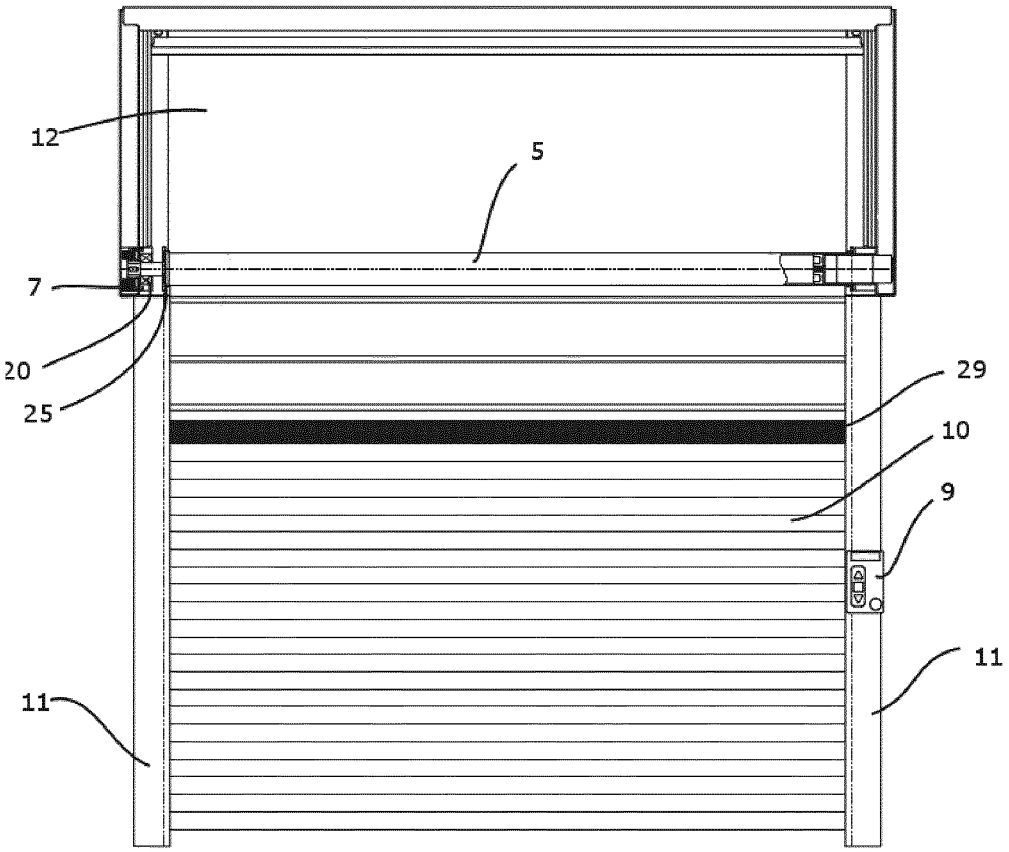
FIG. 8 shows a sectional view of a fifth embodiment.

The embodiment shown in FIG. 8 corresponds substantially to the embodiment in FIG. 7. The arrangement of the motor differs, which is there arranged as a tubular motor within the gate panel shaft.

The invention claimed is:

1. A gate with a crash-down prevention mechanism, comprising a gate panel which can be opened and closed by rotation of a gate panel drive which has a gate panel shaft, a motor which is coupled to said gate panel drive, a braking assembly with which opening and/or closing said gate panel can be decelerated, a first measuring device for determining at least one movement parameter of said gate panel, a second measuring device for determining at least one movement parameter of said motor, and a comparator which compares the measured movement parameters of said gate panel and said motor and triggers said braking assembly if the measured movement parameters of said gate panel and said motor fall outside a defined relationship to each other, wherein the second measuring device is provided at a holding brake which is provided at the motor, wherein the first measuring device is provided at a motor side end of the gate panel shaft, wherein said braking assembly comprises a friction brake, where a braking element of said friction brake is in frictional engagement with a braking surface of a disk brake rotating along with said gate panel shaft when said braking assembly is triggered, wherein the braking assembly is provided at an opposite end side of the gate panel shaft opposite to the motor side end of the gate panel shaft, such that the first measuring device is positioned on an opposite side of the gate panel shaft relative to the braking assembly.

2. The gate according to claim 1, characterized in that a movement parameter of said gate panel determined by said first measuring device is a translation speed of said gate panel.

3. The gate according to claim 1, characterized in that a movement parameter of said gate panel determined by said first measuring device is an angular position of said gate panel drive.

4. The gate according to claim 1, characterized in that a movement parameter of said motor determined by said second measuring device is a rotational speed of a rotating motor shaft.

5. The gate according to claim 1, characterized in that a movement parameter of said motor determined by said second measuring device is an angular position of a rotating motor shaft.

6. The gate according to claim 1, characterized in that said motor is adapted to be controlled to a standstill of said motor, where said gate panel can be held in a position and where said motor is a synchronous motor.

7. The gate according to claim 1, characterized in that said braking assembly can stop a closing motion of said gate panel within a defined stopping distance.

8. The gate according to claim 1, characterized in that at least one drive wheel formed on said gate panel drive can engage at least one drive device extending in a height direction of said gate.

9. The gate according to claim 1, characterized in that said gate in an open position is stored in a spiral guide.

10. A method for triggering a crash-down prevention mechanism of a gate with a gate panel which can be opened and closed by rotation of a gate panel drive which has a gate panel shaft, where at least one movement parameter of said gate panel is determined by way of a first measuring device, at least one movement parameter of a motor is determined by way of a second measuring device, the measured movement parameters of said gate panel and of said motor are compared by way of a comparator, and a braking assembly which decelerates the opening and/or closing of said gate is triggered if said movement parameters of said motor and said gate panel fall outside a defined relationship, wherein the second measuring device is provided at a holding brake which is provided at the motor, wherein the first measuring device is provided at a motor side end of the gate panel shaft, wherein said braking assembly comprises a friction brake, where a braking element of said friction brake is in frictional engagement with a braking surface of a disk brake rotating along with said gate panel shaft when said braking assembly is triggered, wherein the braking assembly is provided at an opposite end side of the gate panel shaft opposite to the motor side end of the gate panel shaft, such that the first measuring device is positioned on an opposite side of the gate panel shaft relative to the braking assembly.

11. The method according to claim 10, characterized in that a translation speed of said gate panel is determined by way of said first measuring device.

12. The method according to claim 10, characterized in that an angular position of said gate panel drive is determined by way of said first measuring device.

13. The method according to claim 10, characterized in that a rotational speed of a rotating motor shaft of said motor is determined by way of said second measuring device.

14. The method according to claim 10, characterized in that an angular position of a rotating motor shaft of said motor is determined by way of said second measuring device.

15. The method according to claim 10, characterized in that said braking assembly stops a closing motion of said gate within a defined stopping distance.

* * * * *